US007112127B2

(12) United States Patent
Watson

(10) Patent No.: US 7,112,127 B2
(45) Date of Patent: Sep. 26, 2006

(54) JOINT COMPOUND SANDER

(76) Inventor: Adam DeWain Watson, 7A8 Park Shore Dr., Naples, FL (US) 34103

( * ) Notice: Subject to any disclaimer, the term of this patent is extended or adjusted under 35 U.S.C. 154(b) by 84 days.

(21) Appl. No.: 10/726,804

(22) Filed: Dec. 3, 2003

(65) Prior Publication Data

US 2005/0124271 A1 Jun. 9, 2005

(51) Int. Cl.
*B24B 23/00* (2006.01)

(52) U.S. Cl. ..... 451/356; 451/456

(58) Field of Classification Search ..... 451/59, 451/351, 356, 456
See application file for complete search history.

(56) References Cited

U.S. PATENT DOCUMENTS

| | | | | |
|---|---|---|---|---|
| 4,158,935 | A | 6/1979 | Robert | |
| 4,202,140 | A | 5/1980 | Alessio | |
| 4,302,910 | A | 12/1981 | Tschacher | |
| 4,381,628 | A * | 5/1983 | Dicke | 451/356 |
| 4,527,360 | A * | 7/1985 | Dicke | 451/356 |
| 4,686,797 | A | 8/1987 | Hoffman | |
| 4,729,195 | A * | 3/1988 | Berger | 451/357 |
| 4,759,155 | A | 7/1988 | Shaw | |
| 4,779,385 | A * | 10/1988 | Reiter | 451/354 |
| 4,920,702 | A | 5/1990 | Kloss | |
| 5,001,869 | A * | 3/1991 | Hutchins | 451/356 |
| 5,007,206 | A | 4/1991 | Paterson | |
| 5,123,216 | A | 6/1992 | Kloss | |
| 5,283,988 | A | 2/1994 | Brown | |
| 5,419,737 | A * | 5/1995 | Brazell et al. | 451/453 |
| 5,885,145 | A | 3/1999 | O'Mara | |
| 6,347,985 | B1 * | 2/2002 | Loveless | 451/354 |
| 6,447,383 | B1 * | 9/2002 | Oda et al. | 451/357 |
| 6,454,640 | B1 * | 9/2002 | Siedler et al. | 451/357 |
| 6,468,141 | B1 | 10/2002 | Conboy et al. | |
| 6,514,131 | B1 * | 2/2003 | Reich et al. | 451/344 |

FOREIGN PATENT DOCUMENTS

| | | |
|---|---|---|
| DE | 2048649 | 4/1972 |
| EP | 0 404 133 B1 | 6/1990 |

* cited by examiner

*Primary Examiner*—Eileen P. Morgan
(74) *Attorney, Agent, or Firm*—Timotny P. O'Hagan

(57) ABSTRACT

A joint compound sanding device (10) comprises a hand held housing (12) and a bottom plate (66) coupled to the hand held housing (12). The bottom plate (66) includes a plurality of dust collection apertures (74) extending through the bottom plate (66) between a vacuum manifold (64) and a bottom surface (76). A plurality of dust collection channels (78) are formed in the bottom surface (76) defining mesas (80) there between. The mesas support a porous joint compound sanding screen (54). A motor is coupled to hand held housing (12) and includes a rotating shaft coupled and rotating to a dust collection fan (30) such that air is drawn through a porous joint compound sanding screen (54), through the channels (78), through the dust collection apertures (74) into the vacuum manifold (64) and through the fan inlet (32) and expelling the air into an exhaust manifold (34).

8 Claims, 5 Drawing Sheets

JOINT COMPOUND SANDER

TECHNICAL FIELD

The present invention relates to portable electric hand tools, and in particular to a portable electric sander useful for capturing dust generating when sanding joint compound and useful for sanding joint compound in acute angle corners.

BACKGROUND OF THE INVENTION

When installing drywall in a facility, large panels of drywall are nailed or screwed to structural studs. Each nail or screw leaves a recess in the surface of the dry wall panel and gaps exist between adjacent dry wall panels. Typically the gaps between panels are covered with a tape and a joint compound is used to: i) fill the recesses in the surface caused by the nail or screw; ii) cover and blend the surface of the tape to the surface of the panels; and iii) fill remaining damage and imperfections in the surface of the panels.

The joint compound is applied in a wet state. After the joint compound hardens and dries, it is sanded such that a smooth surface is formed across multiple dry wall panels. Traditional sanding paper typically become clogged with joint compound dust which renders the sanding paper ineffective quite quickly. Porous sanding screens supported by a rubber or foam sanding block are an improvement over traditional sanding paper as the user may periodically flex the screen with respect to the block to remove joint compound dust clogging the screen. While this solution resolves the clogging problem, hand sanding with a screen remains tedious and the repetitive task of removing clogged joint compound from the screen is time consuming at best.

Existing hand held power sanders are also useful for sanding joint compound, however several problems exist with using existing power sanders. First, if the power sander can only accommodate traditional sanding paper, the sanding paper will become clogged with joint compound dust very quickly rendering it ineffective.

Second, If the sander is of a an orbital or rotary type, it will tend to leave swirl marks and is impractical for sanding joint compound applied in a corner wherein two drywall panels meet at an acute angle.

Thirdly, even if the sander is limited to linear motion, it may still be impractical for sanding joint compound applied in a corner if the structure of the sander does not enable the abrasive to contact the joint compound in the corner.

What is needed is portable powered dry wall sanding tool that does not suffer the disadvantages of known systems.

SUMMARY OF THE INVENTION

A first aspect of the present invention is to provide a joint compound sanding device for supporting a porous joint compound sanding screen. The joint compound sanding device comprises a hand held housing and a bottom plate.

The bottom plate includes a plurality of dust collection apertures extending through the bottom plate between a vacuum manifold and a bottom surface of the bottom plate. A plurality of dust collection channels are formed in the bottom surface to define mesas there between. The mesas support the porous joint compound sanding screen. A dust collection fan with a fan inlet is joined to the vacuum manifold.

A motor is coupled to hand held housing. The motor includes a rotating shaft coupled to the dust collection fan for rotating the dust collection fan such that air is drawn through the porous joint compound sanding screen, through the channels, through the dust collection apertures into the manifold and through the fan inlet and expelled into an exhaust manifold.

The joint compound sanding device may further comprise means coupled to the motor for moving the base with respect to the housing in a linear motion.

In a first exemplary embodiment, each channel may be on the order of one sixteenth inch wide and one sixteenth inch deep and extend in a radial direction from a dust collection aperture. The mesa region forms a perimeter around the periphery of the base to restrict the flow of air into the channels to only that air that has been drawn through the porous joint compound sanding screen.

In a second exemplary embodiment, each mesa may be on the order of one sixteenth inch in width and height thereby forming channels there-between. A perimeter mesa around the periphery of the base restricts the flow of air into the channels to only air that has been drawn through the porous joint compound sanding screen.

In an exemplary embodiment, the bottom plate, the top surface, and the side walls form a base. The base may further include a lateral slot extending in a lateral direction and at least one track extending in a longitudinal direction (perpendicular to the lateral direction) for coupling to a matting track of the housing and permitting motion of the base with respect to the housing in a longitudinal direction while restricting motion of the base with respect to the housing in the lateral direction.

An idler, driven by the spinning shaft of the motor, may spin in a plane parallel to the base. The idler may include an off axis drive lug engaged in the lateral slot thereby causing the base to oscillate with respect to the housing in the longitudinal direction.

The dust collection fan may be an impeller fan with a centrally located fan inlet and a peripherally located exhaust manifold. Alternatively, the dust collection fan may be a propeller fan with the fan inlet and the exhaust manifold located on opposing sides of a plane formed by the spinning propeller fan.

The base of the joint compound sanding device may further comprise a mounting for supporting an extension. The extension comprises an abrasive surface generally planar to the bottom surface of the base when supported by the mounting.

In an exemplary embodiment, the mounting may comprise a tube for engaging a pin secured to the extension and means for securing the pin within the tube. The tube may extend in the lateral direction across the base and the means for securing the pin within the tube may be located within the center of the base to permit the extension to be mounted to either side of the base.

In such embodiment, the pin extends into the tube a distance at least half of the width of the base in the lateral direction and includes an engagement slot. The means for securing the pin within the tube comprises an engagement plate positioned in the center of the base in the lateral direction for engaging the engagement slot.

A second aspect of the present invention is to provide a joint compound sanding device for supporting a porous joint compound sanding screen. The joint compound sanding device comprises a hand held housing and a bottom plate. The housing comprises a vacuum port for coupling the device to an external vacuum dust collection system.

The bottom plate includes a plurality of dust collection apertures extending through the bottom plate between a vacuum manifold and a bottom surface of the bottom plate.

The bottom surface comprises mesas and channels. The vacuum manifold is coupled to the vacuum port such that air is drawn through the porous joint compound sanding screen, through the channels, through the dust collection apertures into the manifold and through the fan inlet and expelled into an exhaust manifold.

The joint compound sanding device further comprises means for moving the bottom plate with respect to the housing in a linear motion.

The vacuum manifold may be defined by the bottom plate, a top surface and side walls extending around the periphery of the bottom plate. The top surface may include a central aperture there-through and joined with manifold whereby air that is drawn through the porous joint compound sanding screen is drawn through the channels, through the dust collection apertures into the vacuum manifold and through the central aperture to the manifold.

The bottom plate, the top surface, and the side walls may form a base. The means for moving the bottom plate with respect to the housing may comprise means for moving the base with respect to the housing in a linear motion. More specifically, the means for moving the base with respect to the housing may comprise: i) at least one track extending in a longitudinal direction for coupling to a matting track of the housing and permitting motion of the base with respect to the housing in the longitudinal direction while restricting motion of the base with respect to the housing in a lateral direction; ii) a lateral slot extending in the lateral direction; and iii) a motor rotating an idler. The idler may spin in a plane parallel to the base and include an off axis drive lug engaged in the lateral slot thereby causing the base to oscillate with respect to the housing in the longitudinal direction.

A third aspect of the present invention is to provide a method of sanding hardened joint compound. The method comprises securing a porous joint compound sanding screen to a bottom plate. The bottom plate comprises: i) a plurality of dust collection apertures extending through the bottom plate between the vacuum manifold and a bottom surface of the bottom plate; and ii) a plurality of dust collection channels formed in the bottom surface defining mesas there between, the mesas for supporting a porous joint compound sanding screen.

The method further comprises moving the bottom plate in a linear motion with respect to a hand held housing to create linear sanding action and forming a vacuum within a vacuum manifold above the bottom plate to draw air and dust through the porous joint compound sanding screen, through the channels, through the dust collection apertures and into the vacuum manifold.

The vacuum manifold may be defined by the bottom plate, a top surface and side walls extending around the periphery of the bottom plate. The top surface then includes a central aperture there-through and is joined with a fan inlet. As such a fan performs the step of drawing the air and dust through the porous joint compound sanding screen, through the channels, and through the dust collection apertures into the vacuum manifold.

For a better understanding of the present invention, together with other and further aspects thereof, reference is made to the following description, taken in conjunction with the accompanying drawings. The scope of the present invention is set forth in the appended claims.

DETAILED DESCRIPTION OF THE EXEMPLARY EMBODIMENTS

Figure 1A:
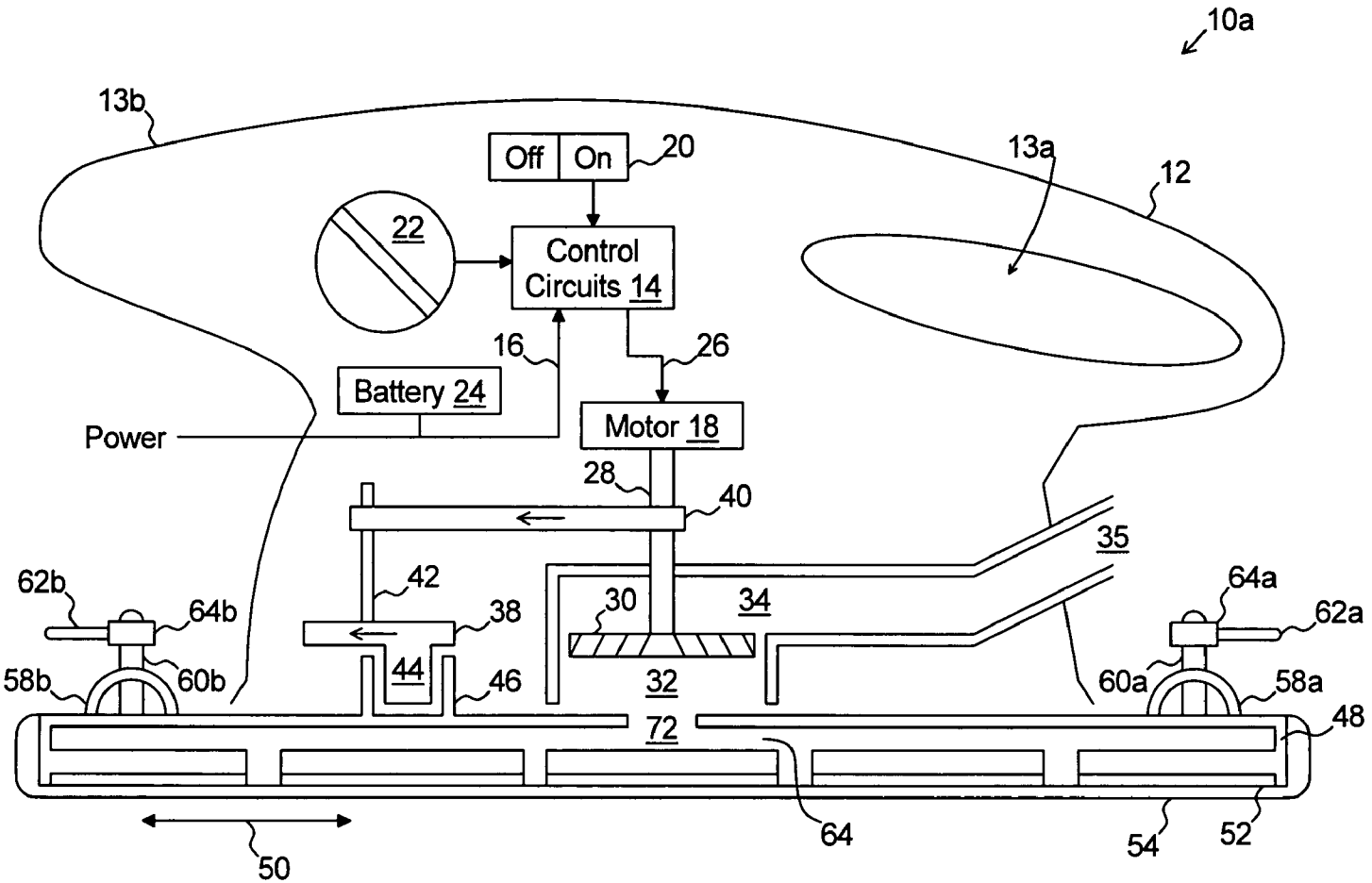
FIG. 1*a* shows a side view, partially cut away, of a first exemplary embodiment of a joint compound sander 10 in accordance with the present invention.

The present invention will now be described in detail with reference to the drawings. In the drawings, each element with a reference number is similar to other elements with the same reference number independent of any letter designation following the reference number. In the text, a reference number with a specific letter designation following the reference number refers to the specific element with the number and letter designation and a reference number without a specific letter designation refers to all elements with the same reference number independent of any letter designation following the reference number in the drawings.

FIG. 1*a* shows a side view, partially cut away, of a first exemplary embodiment of a joint compound sander 10*a* in accordance with the present invention. The joint compound sander 10*a* comprises a housing 12 formed of a plastic or other durable material. In addition to being a chassis and supporting the elements discussed herein, the housing 12 forms the external surface of the sander 10*a* and is shaped with one or more handles 13*a* and 13*b* for easy operation by an operator.

Within the housing 12 is a control circuit 14. The control circuit 12 receives operating power 16 from a remote power source (such as through an electrical cable or from a battery 24). The control circuit 14 provides controlled power 26 to an electric motor 18 in accordance with input control signals provided by an on/off switched 20 and a variable speed control rheostat 22.

The motor 18 is secured to the housing 12 and includes a spinning shaft 28. The spinning shaft 28 is coupled to, and rotates, a dust collection fan 30. The dust collection fan 30 may be an impeller fan which includes an inlet 32 at its center and, when spinning, forces dust and air from the inlet 32 to an exhaust manifold 34 at the periphery of the fan 30. The exhaust manifold 30 vents outside the housing through a vacuum port 35 to a dust collection bag or external vacuum dust collection system. Alternatively, the fan 30 may be a propeller fan including the inlet 32 located below a plane defined by a spinning propeller fan 30 and the exhaust manifold 34 above the plane.

The spinning shaft 28 also couples to an idler 38 driven by a drive belt 40. The idler 38 is secured to the housing 12 and rotates about a shaft 42 which is parallel to the motor shaft 28. The idler includes an off axis drive lug 44 which rotates in a circle about an axis defined by shaft 42 when the idler 38 is rotated. As will be discussed in more detail with respect to FIG. 2, the drive lug 44 fits within a lateral slot 46 of the base 48 and causes the base 48 to oscillate in a longitudinal direction 50 at the same frequency at which the idler 38 rotates.

Figure 4:
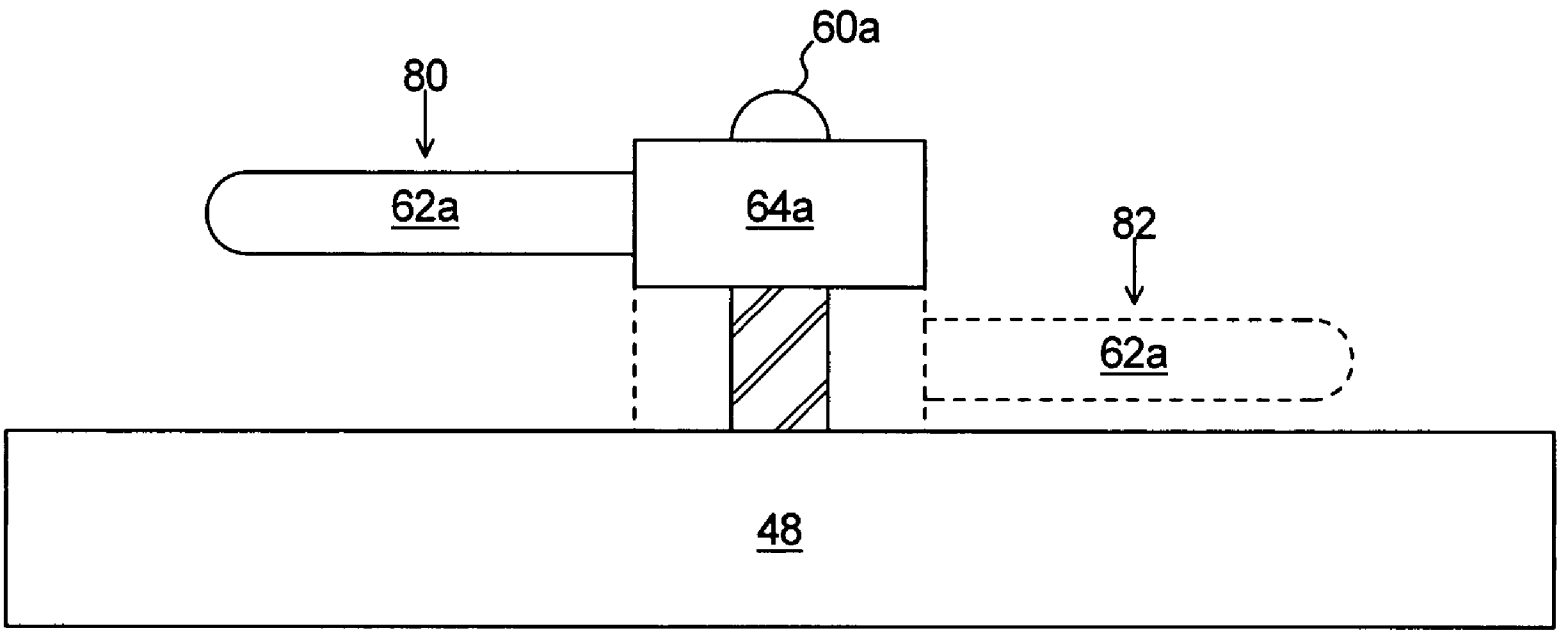
FIG. 4 shows a plan view of a base and certain components of a joint compound sander in accordance with the present invention.

The base 48 includes a bottom surface 52 which supports a joint compound sanding screen 54 in a plane for sanding a surface. The sanding screen 54 is secured to the base 48 by a first clamp 58*a* and a second clamp 58*b*. Referring briefly to FIG. 4 in conjunction with FIG. 1*a*, operation of the first clamp 58*a* is shown. The first clamp 58*a* is secured against a top surface of the base 48 and thereby traps the sanding screen 54 there between. The first clamp 58*a* is secured against the top surface of the base by a locking nut 64*a* screwed onto a threaded shaft 60*a*. A lever handle 62*a* secured to the nut 64*a* enables an operator to twist the locking nut 64*a* with significant torque from position 80 to position 82 (shown in dashed lines) for locking and unlocking the sanding screen 54. The second clamp 58*b* has similar structure and operates in a similar manner and is secured at an opposing end (in the longitudinal direction 50) of the base 48.

Figure 2:
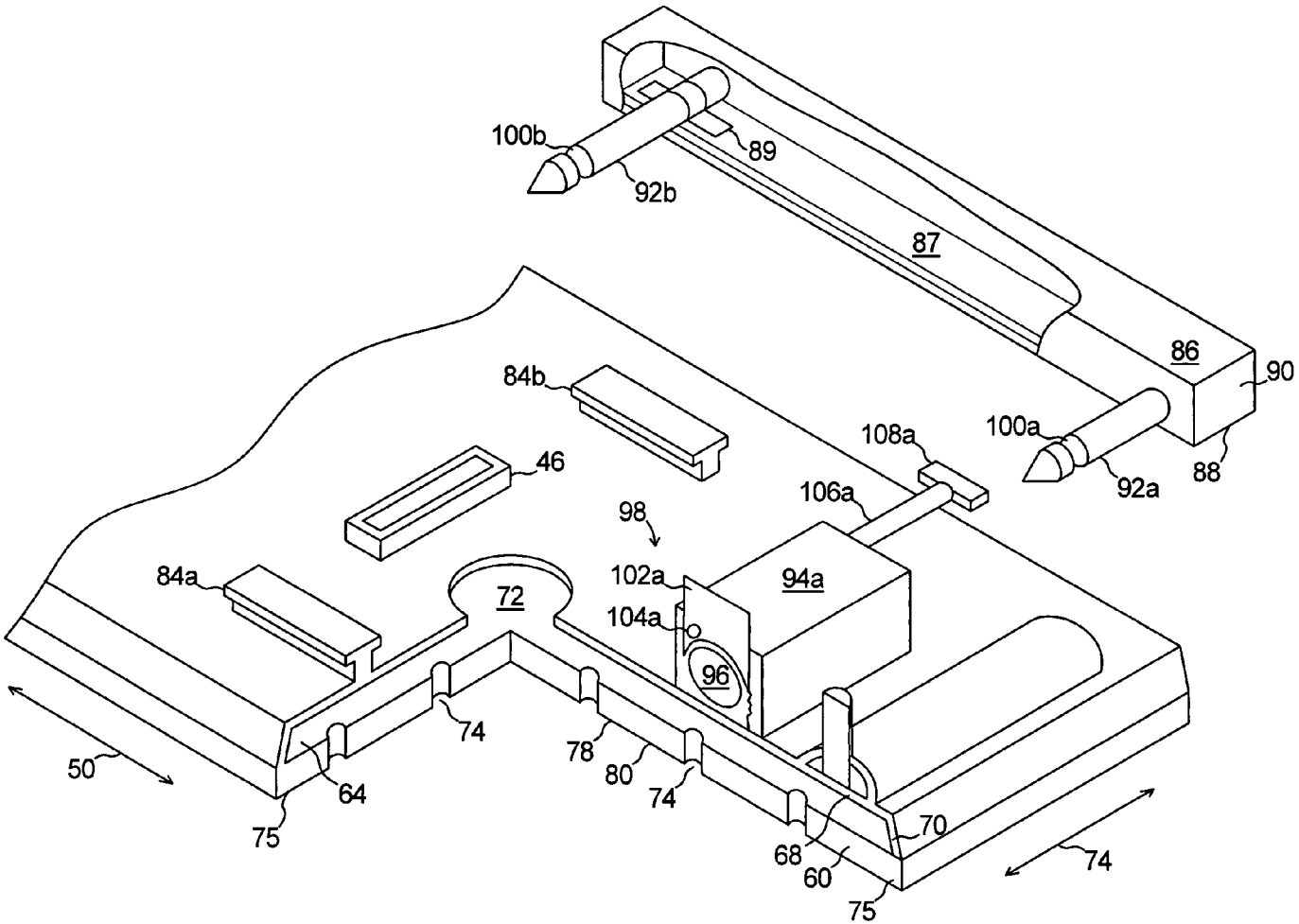
FIG. 2 shows a perspective view, partially cut away, of a base and certain components of a joint compound sander 10 in accordance with an exemplary embodiment of the present invention.

Referring to FIG. 2 in conjunction with FIG. 1*a*, the base 48 includes a vacuum manifold 64 formed above a bottom plate 66. The vacuum manifold 64 may be defined by the bottom plate 66, a top surface 68, and sidewalls 70. A central aperture 72 is positioned to join with the inlet 32 of the fan 30 such when fan 30 is rotated, air and dust within the vacuum manifold 64 is drawn into the fan 30. The sidewalls 70 are at the periphery of the base 48 such that the vacuum manifold 64 extends across the entire base 48 in both the lateral direction 74 and the longitudinal direction 50.

In the exemplary embodiment shown in FIG. 2, the top surface 68 and the side walls 70 are secured to, and move in conjunction with, the bottom plate 66. In an alternative embodiment, the top surface 68 and the side walls 70 may be part of the housing 12 (or secured to the housing 12) such that there is relative motion between the side walls 70 and the bottom plate 66.

The bottom plate 66 includes a plurality of dust collection apertures 74. A bottom surface 76 of the bottom plate 66 supports the sanding screen 54. The bottom surface 76 includes a plurality of mesas 78 and channels 80 whereby the mesas 78 support the sanding screen 54 and each of the channels 80 is interspaced between mesas 78 to form a duct behind the sanding screen 54 for the flow of air and dust towards a dust collection aperture 74.

Figure 3A:
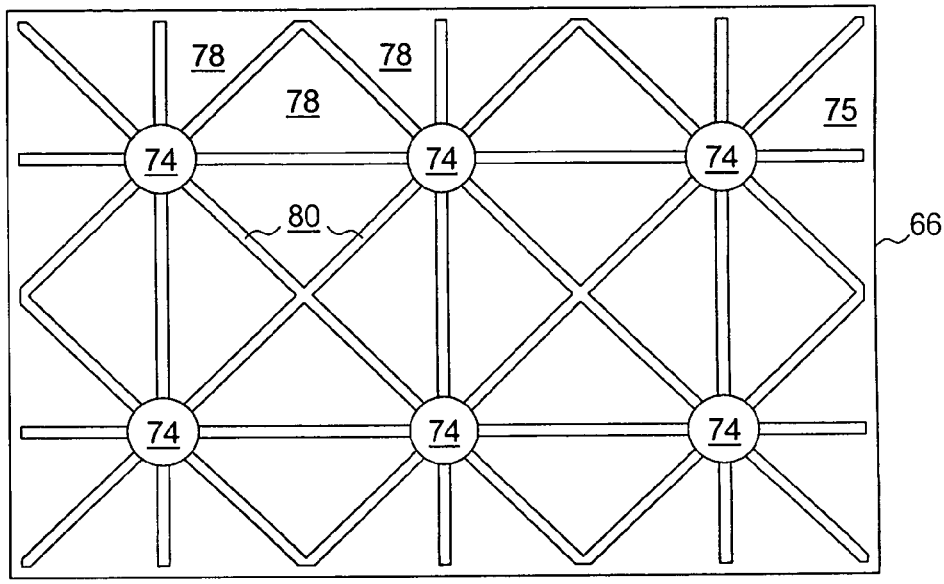
FIG. 3*a* shows a plan view of a bottom of the base of a joint compound sander in accordance with a first embodiment of the present invention.

Referring briefly to FIG. 3*a*, a first exemplary pattern of mesas 78 and channels 80 is shown. Each channel 80 may be 1/16 inch wide and 1/16 inch deep channel 80 formed in planar surface thereby defining each mesa 78 and forming bottom surface 76. In this first exemplary embodiment, each channel 80 extends in a radial direction from a dust collection aperture. The mesa 78 extends around the periphery of the bottom surface 76 to restrict the flow of air into the channels 80 to only that air that has been drawn through the porous joint compound sanding screen 54.

Figure 3B:
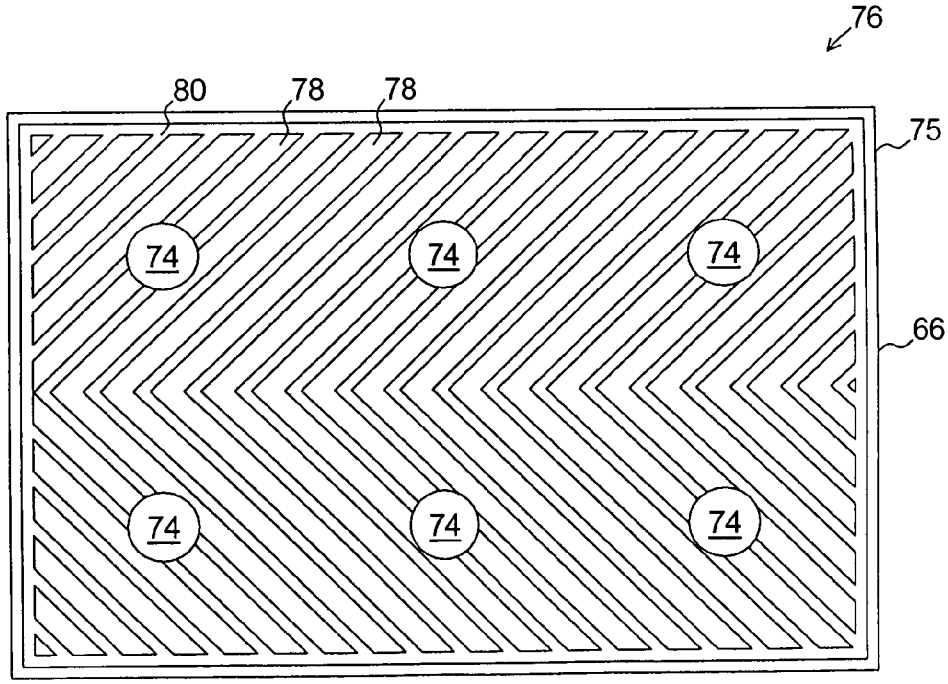
FIG. 3*b* shows a plan view of a bottom of the base of a joint compound sander in accordance with a second embodiment of the present invention.

Referring briefly to FIG. 3*b*, a second exemplary pattern or mesas 78 and channels 80 is shown. Each mesa may be 1/16 inch wide and 1/16 inch in height formed a planar surface defining channels there-between. In this second embodiment, a perimeter mesa 75 extends around the periphery of the bottom surface 76 to restrict the flow of air into the channels 80 to only that air that has been drawn through the porous joint compound sanding screen 54.

Returning to FIGS. 1*a* and 2, in operation, dust generated by the abrasive sanding screen 54 is drawn through the screen 54, along a channel 80 towards a dust collection aperture 74, through the dust collection aperture 74 into the vacuum manifold 64, through the central aperture 72 and inlet 32 of the fan 30, and then forced, by operation of the fan 30, into the exhaust manifold 34 and into the dust collection bag 36. By drawing the dust through the screen 54, clogging of the sanding screen 54 by dust becoming trapped in the screen 54 is reduced or eliminated.

In the exemplary embodiment, the base 48 (supporting the sanding screen 54) oscillates in the longitudinal direction 50 with respect to the housing 12. The base includes two tracks 84*a* and 84*b* secured to the base 48. Each track 84 mates with a corresponding track formed in the housing 12 to permit a sliding motion in the longitudinal direction 50 while preventing movement in the lateral direction 74. In the exemplary embodiment, each track may be structured as a linear bearing to prevent excessive friction and heat build up by the linear motion of the base 48 with respect to the housing 12.

The linear motion is caused by the orbital motion of the drive lug 44 within the lateral slot 46. As the idler 38 spins, the off axis drive lug 44 moves in an orbital pattern. The lateral component of the orbital pattern moves the drive lug 44 laterally within the slot 46 while the longitudinal motion of the drive lug 44 moves the slot and the base 48 in the longitudinal direction.

To facilitate sanding of joint compound in acute corners, an extension 86 may be coupled to the base 48 such that the extension oscillates in the longitudinal direction 50 in unison with the base 48. The extension 86 may have an abrasive surface, or support abrasive sanding paper or a sanding screen on its bottom surface 88 and its outer surface 90.

The extension 86 may have two pins 92*a* and 92*b*, each of which secures in a mounting 94*a* and 94*b* on the top side of the base 48. As shown in the cut away, a reinforcement plate 87 sits at the bottom surface 88 of the extension and extends between the two ins 92*a* and 92*b*, and is secured to each such pin by a bracket 89 such that abrasive on the bottom surface 88 moves in unison with the pins 92*a* and 92*b*.

In the exemplary embodiment, the mounting 94*a* may include a tube 96, with an axis in the lateral direction 74, and a co-axial aperture 96 into which the pin 92*a* securely fits. Motion of the base (including the tube 96) in the longitudinal direction causes corresponding motion of the extension 86.

The mounting 94*a* may include a locking mechanism 98*a* for securing the pin 92*a* within the tube 96. In the exemplary embodiment, the locking mechanism 98 includes a locking plate 102*a* for engaging a corresponding locking slot 100*a* in the pin 92*a*. The locking plate 102*a* is movable about a hinge point 104*a* such that it may be moved between a locked position and an unlocked position by rotating the locking plate 102*a* about the hinge point 104*a*. An extension 106*a* (such as a rod) may be secured to the locking plate 102*a* at the hinge point 104*a* and secure in a tube thereby forming a hinge at the hinge point 104*a*. The extension 106*a* may include wings 108*a* for easy twisting of the extension 106*a* by an operator to move the locking plate 102*a* between the locked an unlocked position.

In the exemplary embodiment, the locking plate 102*a* is located within the center of the base (center in the lateral direction 74) such that the extension 86 may be mounted to either the left side 110 or the right side 112 of the base 48.

The mounting 94*b* has similar structure and operates in a similar manner and is secured at an opposing end (in the longitudinal direction 50) of the base 48 for engaging pin 92*b*.

Figure 1B:
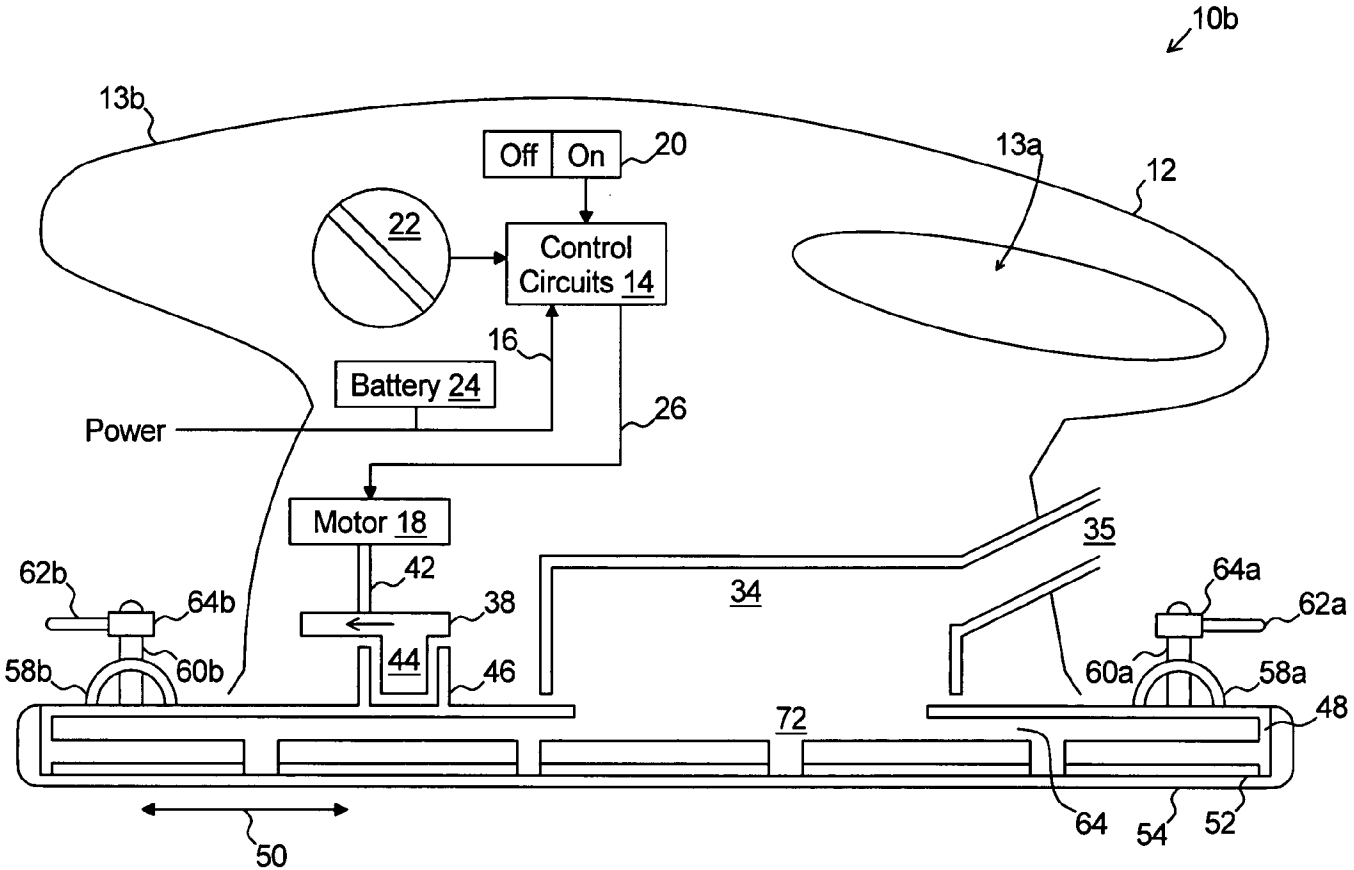
FIG. 1*b* shows a side view, partially cut away, of a second exemplary embodiment of a joint compound sander 10 in accordance with the present invention.

FIG. 1*b* shows a side view, partially cut away, of a second exemplary embodiment of a joint compound sander 10*b* in accordance with the present invention. The joint compound sander 10*b*, like the first embodiment joint compound sander 10*a* of FIG. 1*a*, comprises a housing 12 which functions as a chassis, forms the external surface of the sander 10*b*, and is shaped to include one or more handles 13*a* and 13*b* for easy operation by an operator.

Within the housing 12 is a control circuit 14. The control circuit 12 receives operating power 16 from a remote power source (such as through an electrical cable or from a battery 24). The control circuit 14 provides controlled power 26 to an electric motor 18 in accordance with input control signals provided by an on/off switched 20 and a variable speed control rheostat 22.

The motor 18 is secured to the housing 12 and includes a spinning shaft 28. The spinning shaft 28 is coupled to, and rotates, the idler 38. The idler 38 is secured to the housing 12. As previously discussed, the idler 38 includes an off axis drive lug 44 which rotates in a circle about an axis defined by shaft 42 when the idler 38 is rotated thereby causing the base 48 to oscillate in a longitudinal direction 50 at the same frequency at which the idler 38 rotates.

The base 48 includes a bottom surface 52 which supports a joint compound sanding screen 54 in a plane for sanding a surface. As previously discussed with reference to FIG. 2, the base 48 includes a vacuum manifold 64 formed above a bottom plate 66. The vacuum manifold 64 may be defined by the bottom plate 66, a top surface 68, and sidewalls 70. A central aperture 72 is positioned to join with the exhaust manifold 34. Again, the exhaust manifold 34 is coupled to a vacuum port 35 such that when an external vacuum dust collection system is coupled to the vacuum port 35, dust generated by the abrasive sanding screen 54 is drawn through the screen 54, along a channel 80 towards a dust collection aperture 74, through the dust collection aperture 74 into the vacuum manifold 64, through the central aperture 72 into the exhaust manifold 34 and drawn through the vacuum port 35 towards the external vacuum dust collection system.

In summary, it should be appreciated that the joint compound sander of the present invention provides for the collection of dust generated during sanding of joint compound and with advantages not known in present systems.

Although the invention has been shown and described with respect to certain preferred embodiments, it is obvious that equivalents and modifications will occur to others skilled in the art upon the reading and understanding of the specification. The present invention includes all such equivalents and modifications, and is limited only by the scope of the following claims.

What is claimed is:

1. A joint compound sanding device comprising:

a hand held housing;

a bottom plate including;

a plurality of dust collection apertures extending through the bottom plate between a vacuum manifold and a bottom surface of the bottom plate;

a plurality of dust collection channels formed in the bottom surface of the bottom plate defining mesas there between, the mesas for supporting a porous joint compound sanding screen;

a dust collection fan with a fan inlet joined to the vacuum manifold;

a motor coupled to the hand held housing with a rotating shaft coupled to the dust collection fan for rotating the dust collection fan such that air is drawn through a porous joint compound sanding screen, through the channels, through the dust collection apertures into the vacuum manifold and through the fan inlet and expelling the air into an exhaust manifold;

wherein the vacuum manifold is defined by the bottom plate, a top surface and side walls extending around the periphery of the bottom plate, and wherein the top surface includes a central aperture there-through and joined with the fan inlet whereby air that is drawn through the porous joint compound sanding screen is drawn through the channels, through the dust collection apertures into the vacuum manifold and through the central aperture to the fan inlet;

wherein the bottom plate, the top surface, and the side walls form a base; and the joint compound sanding device further comprises means for moving the base with respect to the housing in a linear motion and the means for moving the base with respect to the housing comprises;

at least one track extending in a longitudinal direction for coupling to a matting track of the housing and permitting motion of the base with respect to the housing in the longitudinal direction while restricting motion of the base with respect to the housing in a lateral direction;

a lateral slot;

the joint compound sanding device further comprises an idler spinning in a plane parallel to the base and comprising an off axis drive lug engaged in the lateral slot; and the motor further rotates the idler thereby causing the base oscillate with respect to the housing in the longitudinal direction.

2. The joint compound sanding device of claim 1, wherein the base further comprises a mounting for supporting an extension, the extension comprising an abrasive surface generally planar to the bottom surface of the base when supported by the mounting.

3. The joint compound sanding device of claim 2, wherein the mounting comprising:

a tube for engaging a pin secured to the extension; and means for securing the pin within the tube.

4. The joint compound sanding device of claim 3, wherein:

the pin extending into the tube a distance at least half of the width of the base in a lateral direction and includes an engagement slot; and the means for securing the pin within the tube comprises an engagement plate positioned in the center of the base in the lateral direction for engaging the engagement slot.

5. The joint compound sanding device of claim 1, wherein:

the pin extending into the tube a distance at least half of the width of the base in a lateral direction and includes an engagement slot; and the means for securing the pin within the tube comprises an engagement plate positioned in the center of the base in the lateral direction for engaging the engagement slot.

6. A joint compound sanding device comprising:

a hand held housing comprising a vacuum port for coupling the joint compound sanding device to an external suction source;

a bottom plate including:

a plurality of dust collection apertures extending through the bottom plate between a vacuum manifold and a bottom surface of the bottom plate;

a plurality of dust collection channels formed in the bottom surface defining mesas there between, the mesas for supporting a porous joint compound sanding screen;

a manifold coupling the vacuum manifold to the vacuum port such that air is drawn through an abrasive surface of the porous joint compound sanding screen, through the channels, through the dust collection apertures into the vacuum manifold and through the manifold and vacuum port by the external suction source; and a motor coupled to the hand held housing and coupled to the bottom plate for moving the bottom plate with respect to the housing;

wherein the vacuum manifold is defined by the bottom plate, a top surface and side walls extending around the periphery of the bottom plate, and wherein the top surface includes a central aperture there-through and joined with the manifold whereby air that is drawn through the porous joint compound sanding screen is drawn through the channels, through the dust collection apertures into the vacuum manifold and through the central aperture to the manifold; and means for moving the base with respect to the housing comprising:

at least one track extending in a longitudinal direction for coupling to a matting track of the housing and permitting motion of the base with respect to the housing in the longitudinal direction while restricting motion of the base with respect to the housing in a lateral direction;

a lateral slot; and the motor rotating an idler spinning in a plane parallel to the base and comprising an off axis drive lug engaged in the lateral slot thereby causing the base to oscillate with respect to the housing in the longitudinal direction.

7. A joint compound sanding device comprising:

a hand held housing comprising a vacuum port for coupling the joint compound sanding device to an external suction source;

a bottom plate including:

a plurality of dust collection apertures extending through the bottom plate between a vacuum manifold and a bottom surface of the bottom plate;

a plurality of dust collection channels formed in the bottom surface defining mesas there between, the mesas for supporting the porous joint compound sanding screen;

a manifold coupling the vacuum manifold to the vacuum port such that air is drawn through a porous joint compound sanding screen, through the channels, through the dust collection apertures into the vacuum manifold and through the manifold and vacuum port by the external suction source;

wherein the vacuum manifold is defined by the bottom plate, a top surface and side walls extending around the periphery of the bottom plate, and wherein the top surface includes a central aperture there-through and joined with manifold whereby air that is drawn through the porous joint compound sanding screen is drawn through the channels, through the dust collection apertures into the vacuum manifold and through the central aperture to the manifold;

wherein the means for moving the base with respect to the housing comprises: i) at least one track extending in a longitudinal direction for coupling to a matting track of the housing and permitting motion of the base with respect to the housing in the longitudinal direction while restricting motion of the base with respect to the housing in a lateral direction; and ii) a lateral slot;

the joint compound sanding device further comprises a motor rotating an idler spinning in a plane parallel to the base and comprising an off axis drive lug engaged in the lateral slot thereby causing the base to oscillate with respect to the housing in the longitudinal direction; and wherein the base further comprises a mounting for supporting an extension, the extension comprising an abrasive surface generally planar to the bottom surface of the base when supported by the mounting.

8. The joint compound sanding device of claim 7, wherein the mounting comprising:

a tube for engaging a pin secured to the extension; and means for securing the pin within the tube.

* * * * *